United States Patent [19]

Anton

[11] Patent Number: 4,853,683

[45] Date of Patent: Aug. 1, 1989

[54] ENHANCED CAPACITY DISPLAY MONITOR

[75] Inventor: George S. Anton, Piscataway, N.J.

[73] Assignee: Unisys Corporation, Blue Bell, Pa.

[21] Appl. No.: 147,965

[22] Filed: Jan. 25, 1988

[51] Int. Cl.[4] ..... G09G 1/06

[52] U.S. Cl. ..... 340/720; 340/732; 340/744; 340/748

[58] Field of Search ..... 340/720, 728, 732, 731, 340/744, 748, 749, 723

[56] References Cited

U.S. PATENT DOCUMENTS

| | | | |
|---|---|---|---|
| 4,212,008 | 7/1980 | Hopkins, Jr. | 340/744 |
| 4,283,724 | 8/1981 | Edwards | 340/749 |
| 4,393,378 | 7/1983 | Danielsen et al. | 340/744 |
| 4,435,703 | 3/1984 | Hunt et al. | 340/749 |
| 4,558,370 | 12/1985 | Mitchell et al. | 340/744 |
| 4,604,614 | 8/1986 | Farr et al. | 340/728 |
| 4,697,177 | 9/1987 | Schine | 340/744 |
| 4,734,691 | 3/1988 | Bailey et al. | 340/744 |

OTHER PUBLICATIONS

Nasser et al., "Correction of Phase Distortion in a Television Receiver when used for Character Display Purposes", IBM Technical Disclosure Bulletin, vol. 17, No. 11, Apr. 1975, pp. 3325-3327.

*Primary Examiner*—Gerald L. Brigance
*Assistant Examiner*—Richard Hjerpe
*Attorney, Agent, or Firm*—Albert B. Cooper; Robert S. Bramson; Mark T. Starr

[57] ABSTRACT

The character displaying capacity of a monitor is enhanced by operating the pixel clock at a frequency at which beam narrowing occurs so that adjacent pixels are substantially distinct from each other. The operating clock frequency exceeds the bandwidth of the video channel and is at a frequency higher than the clock frequency at which pixel smearing occurs.

6 Claims, 2 Drawing Sheets

ENHANCED CAPACITY DISPLAY MONITOR

BACKGROUND OF THE INVENTION

1. FIELD OF THE INVENTION

The invention relates to computer monitors particularly with respect to enhancing the character display capacity thereof.

2. DESCRIPTION OF THE PRIOR ART

Present day computer monitors display alphanumeric text by utilizing adjacently disposed character matrices of pixels (picture elements) for displaying the characters. An alphanumeric character is displayed in a pixel matrix by selectively illuminating the pixels of the matrix. Intercharacter spacing is effected by reserving one or more rows and columns of pixels at the edges of the matrix for the space. The number of pixels that can be displayed on a line is limited by the bandwidth of the video driving circuitry and thus the number of characters that can be displayed in a character row of the monitor is similarly limited by the video bandwidth. In order to maximize the number of characters on a line, the frequency of the pixel clock is set for operation at the high frequency band edge of the video amplifier.

If the frequency of the pixel clock is increased somewhat so that operation occurs slightly beyond the high frequency end of the video amplifier bandwidth in order to increase the monitor capacity, a phenomemon denoted as pixel or dot smearing occurs. Since the slew rate of the video amplifier is inadequate to rapidly turn on and off at this increased frequency, the video amplifier does not completely turn off the video gun at the end of a pixel before the start of the next pixel. An adequate black level between pixels is not achieved resulting in inadequate contrast between the dots. Adjacent pixels tend to merge into one another. Because of this phenomemon, elements of the characters run into each other and adjacent characters run into each other severely degrading the legibility of the display.

When utilizing a system that operates just beyond the band edge of the video amplifier, additional characters may be displayed on a line by reducing the width of the character matrix and utilizing a smaller intercharacter spacing. This approach, coupled with the pixel smearing effect further exacerbates display illegibility.

A prior art approach to increasing the number of characters on the line is to increase the bandwidth of the video channel and hence increase the slew rate. The increased slew rate permits the beam to be turned on and off at a high rate thus generating an increased number of pixels on the line with adequate black level therebetween. Increased bandwidth, however, significantly increases the cost of the monitor.

SUMMARY OF THE INVENTION

The disadvantages of the prior art are obviated by increasing the frequency of the pixel clock such that operation occurs sufficiently beyond the high frequency band end of the video driving circuitry such that beam narrowing occurs to counteract the dot smearing effect and to utilize the significant increase in pixels on the line resulting from the increase in clock frequency to provide adequate intercharacter spacing. The operating point on the video driving circuitry frequency bandwidth curve is the point where beam narrowing results in adjacent pixels that are substantially distinct from each other.

DESCRIPTION OF THE PREFERRED EMBODIMENT

Figure 1:
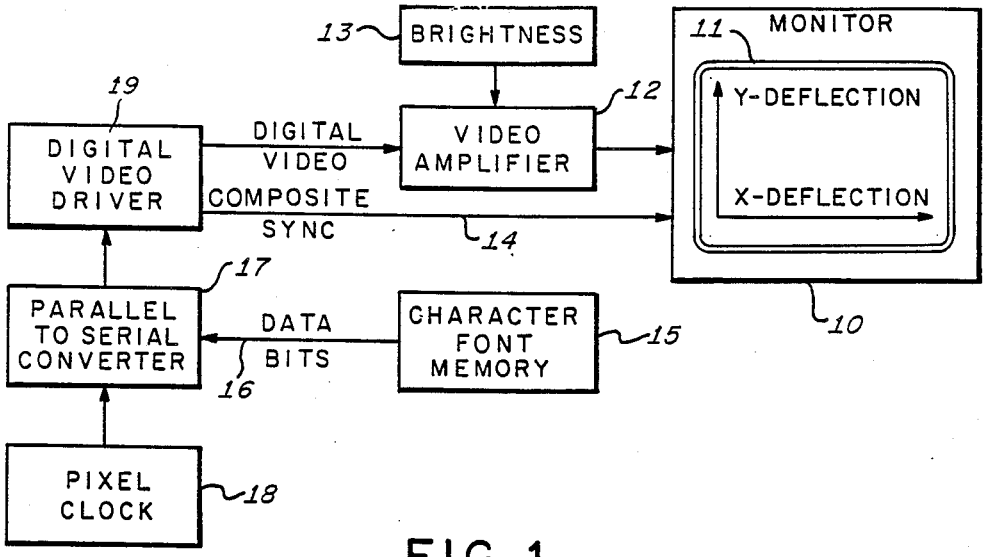
FIG. 1 is a schematic block diagram of a monitor situs in which the present invention may be utilized.

Referring to FIG. 1, a computer monitor display system environment in which the present invention may be utilized is illustrated. The apparatus of FIG. 1 includes a conventional computer monitor 10 having a display screen 11. In a conventional cathode ray tube (CRT) monitor, the beam is deflected in an X direction (X-deflection) and in a Y direction (Y-deflection). Conventional deflection circuitry is included in the monitor 10 for sweeping the beam in the X and Y directions in accordance with a conventional raster scan. The intensity of the beam is controlled by a video amplifier 12 and the brightness level of the display is controlled by conventional brightness circuitry 13. The monitor 10 includes conventional horizontal and vertical sync circuits responsive to composite sync signals on a line 14. It is further appreciated that the video amplifier 12 and the brightness circuitry 13 are conventionally included within the monitor 10 but are illustrated as separate components for convenience.

A character font memory 15 stores a plurality of pixel maps or pages for the repertoire of characters to be selectively displayed on the screen 11. Each page contains a matrix array of bits with binary ones stored at the pixel locations to be illuminated in accordance with the shape of the character to be displayed and binary zeros at the remaining pixel locations in the matrix including the intercharacter spacing. The memory 15 is read by control circuitry (not shown) to selectively provide, in parallel on a bus 16, the data bits from selected character pages.

Figure 1A:
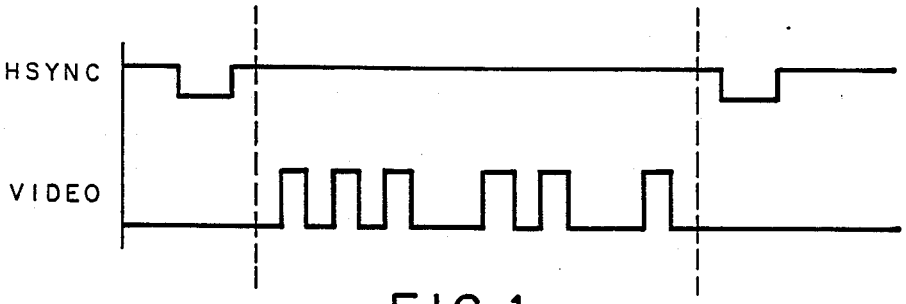
FIG. 1*a* is a timing diagram illustrating the relationship between the sync pulses and the video signals with respect to FIG. 1.

The character data bits on the bus 16 are applied in parallel to a parallel-to-serial converter 17. The converter 17 is responsive to a pixel clock 18 which clocks the converter 17 at the pixel clock frequency. The converter 17 may be a parallel-in serial-out shift register to convert the parallel character font data on the bus 16 into bit serial format at the pixel video rate for application to a digital video driver 19. The digital video driver 19 serially provides the digital video signals to the video amplifier 12 in accordance with the serial character bits provided by the converter 17. The digital video driver 19 also provides, to the deflection circuitry of the monitor 10, the composite sync signals on the line 14 in synchronism with the digital video. The signals are provided by the digital video driver 19 to the monitor 10 to display the pixels across the screen 11 in the appropriate positions required in the raster. FIG. 1*a* illustrates the horizontal sync signal (HSYNC) with the video pulses timed to occur between horizontal sync pulses for generating a line of the raster.

Figure 2:
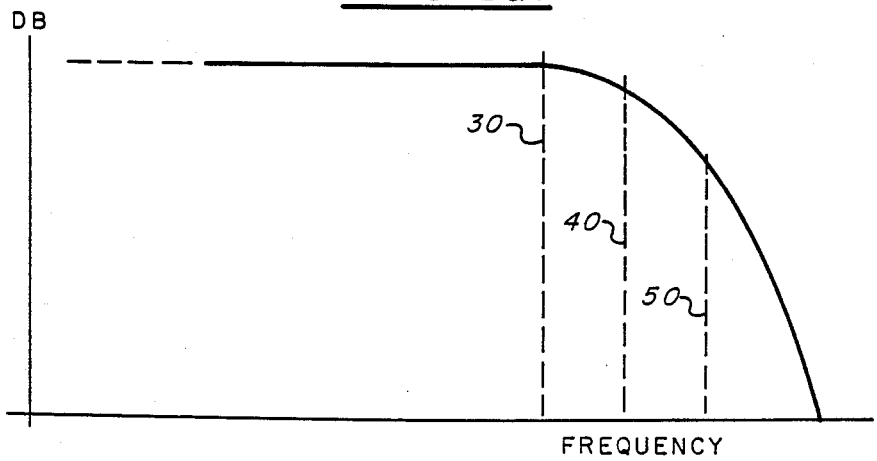
FIG. 2 is the high frequency portion of a typical frequency response curve of the video amplifier of FIG. 1 illustrating operation in accordance with the present invention.
Figure 3A:
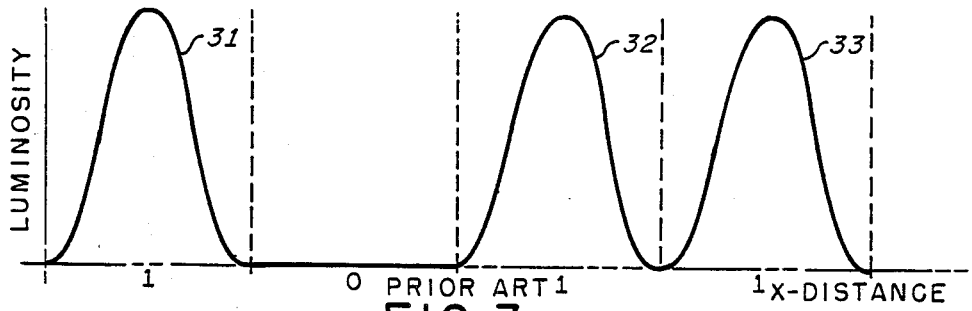
FIG. 3*a* is a luminosity diagram of pixel generation in accordance with proper prior art operation.

Referring to FIG. 2, the high end of the frequency response curve of the video amplifier 12 is illustrated. In the prior art, the monitor 10 is operated at a point 30 which is at the high frequency band edge of the curve. At the point 30, the video amplifier 12 has an adequate slew rate to rapidly turn the beam on, increase to full intensity, and rapidly turn the beam off within a pixel cell of the system. FIG. 3*a* illustrates the luminosity versus X-distance depicting this prior pixel generation process. Four bits are illustrated with an adjacent one and zero as well as adjacent ones. It is observed that a pixel 31 generated in response to a binary one, terminates at the edge of the pixel cell. The next occuring bit, binary zero, provides a good black level at the bit cell. It is further appreciated that with respect to pixels 32 and 33, the video amplifier 12 has adequate bandwidth to provide a good black level therebetween. Because of the rapid turn on and turn off of the beam, proper contrast is provided between pixels and hence between characters resulting in a display with good legibility.

A monitor that exhibits the performance described is commercially procurable from the Unisys Corporation in the product line of work stations provided thereby. The pixel clock utilized is 19.98 MHz. with a 9 by 12 pixel character matrix (9 pixels wide by 12 pixels high) with 80 characters to the line. Thus, when operating at the point 30 (FIG. 2) the monitor 10 provides 720 pixels to the line with good resolution and legibility.

In order to provide mroe information on the display screen 11, it is desirable to increase the number of characters displayed on a line from 80 characters to, for example, 132 characters. Attempting to display 132 characters per line requires a change in the character matrix size. For example, a 6 by 10 character matrix (6 pixels wide by 10 high) may be attempted. A 6 by 10 character matrix requires a slight increase in the frequency of the pixel clock 18. A 6 by 10 character matrix requires 792 pixels per line necessitating a pixel clock of approximately 22 MHz. This operating point is illustrated as point 40 on FIG. 2. Point 40 is slightly outside of the specification frequency band of the video amplifier 12. The point 40 is approximately 5 to 10 DB down from operation within specification limits at the point 30.

Figure 3B:
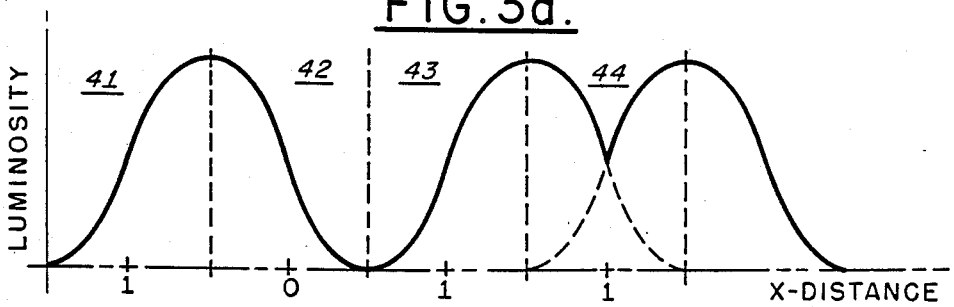
FIG. 3*b* is a luminosity diagram of pixel generation in accordance with improper operation.

Operation at the point 40 results in an unacceptably illegible display. FIG. 3*b* illustrates the bit smearing phenomemon discussed above that contributes to the degredation in legibility. Referring to FIG. 3*b*, a binary one is commanded for display in a pixel cell 41 and a binary zero is commanded for display in a pixel cell 42. The video amplifier 12 does not possess adequate bandwidth or slew rate at the operating point 40 (FIG. 2) to sharply turn the beam on and off within the confines of the cell 41. Thus the beam smears into the cell 42 which should be displaying a black level. The beam smearing phenomemon is further illustrated with respect to pixel cells 43 and 44 wherein binary ones are commanded. It is observed that because of the inadequate video bandwidth and slew rate, the binary one pixels commanded for the cells 43 and 44 smear into one another without adequate black level contrast therebetween.

Because of the beam smearing phenomenon, pixels and characters run into one another seriously degrading the legibility of the display. Additionally a 6 by 10 character matrix only permits a one pixel spacing between characters further exacerbating the degredation in legibility. A prior art solution to the problem would be to increase the bandwidth of the video amplifier 12 but this would significantly increase the cost thereof. It is observed by comparing FIG. 3*b* to FIG. 3*a* that the pixel cell width is smaller in FIG. 3*b* than in FIG. 3*a* thus permitting the additional pixels to be displayed on a line as discussed above with respect to operating at the point 40 (FIG. 2).

A significant enhancement in legibility is effected in accordance with the present invention by operating at a point 50 on the video amplifier frequency response curve of FIG. 2. The point 50 is aproximately 10 to 15 DB down from operation at the point 30 and is significantly outside of the specification bandwidth of the video amplifier 12. The point 50 is effected by selecting a frequency for the pixel clock 18 that results in operation beyond the pixel smearing point 40 of FIG. 2 and where a beam narrowing affect occurs so that adjacent pixels are substantially distinct from each other and legibility improves to a satisfactory level.

Figure 3C:
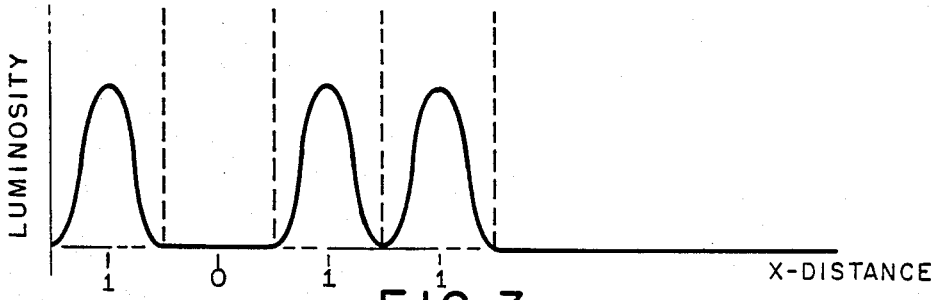
FIG. 3*c* is a luminosity diagram of pixel generation in accordance with the invention.

For the system described above, a pixel clock frequency of 26.4384 MHz. is utilized for operation at the point 50 providing 924 pixels to the line. At this operating point, a character matrix of 7 by 10 pixels may be utilized (7 pixels wide by 10 pixels high), providing 132 characters to the line. The optimum point of operation is where the luminosity between adjacent binary one pixels decreases to the black level. FIG. 3*c* illustrates pixel generation at the operating point 50. Four adjacent pixels are depicted illustrating that pixel luminosity attains the black level at the pixel cell boundary and that adjacent binary one pixels attain the black level therebetween. It is noted that the pixel luminosity amplitude attained during operation at point 50 is less than the luminosity amplitude during operation at point 30 as illustrated in FIG. 3*a*. It is furthermore noted that operation at point 50 generates a narrower pixel cell than operation at point 30. This results in the significant increase in the number of pixels on the raster line.

The beam narrowing effect, which counteracts the beam smearing effect, occurs because the video amplifier 12 does not have the bandwidth at point 50 and hence the slew rate to respond to the applied frequency. The amplifier 12 therefore prematurely turns off and at a lower amplitude than during normal operation. The beam narrowing effect that occurs at the operating point 50 permits the video amplifier 12 to be turned off to a dark level and turned on again for the adjacent pixel providing enhanced interpixel contrast. There is, however, a brightness loss which can readily be compensated by adjustment to the brightness circuitry 13.

By significantly increasing the number of pixels available on the line while counteracting the pixel smearing effect by the beam narrowing effect, provides additional pixels for intercharacter spacing which significantly improves the legibility of the display.

Thus it is appreciated that by operation at the point 50, adequate intercharacter space is available without pixel smearing thereby providing a display with commercially acceptable legibility, with a vastly enhanced character display capacity and without an increase in video channel bandwidth that would otherwise have been expected for the level of performance achieved.

The 7 by 10 character matrix utilizes two pixels of inter-character spacing greatly enhancing the image readability.

Figure 4:
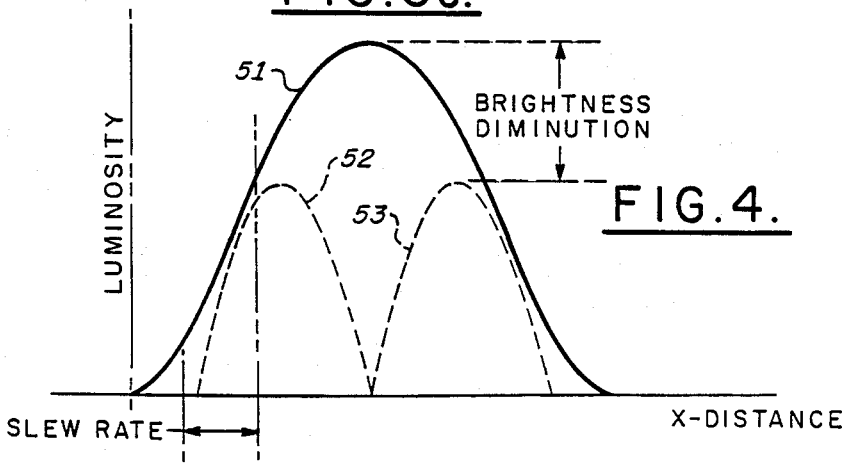
FIG. 4 is a luminosity diagram of pixel generation illustrating prior art operation and operation in accordance with the invention superposed with respect to each other to emphasize the differences therebetween.

Referring to FIG. 4 details of the beam narrowing affect are illustrated. The normal response of the monitor 10 is illustrated by solid line curve 51. The curve 51 is the pixel generation response when operating at the point 30. The dotted line curves comprised of portions 52 and 53 represent the beam narrowing affect caused by exceeding the monitor bandwidth at the point 50. At this operating point, the slew rate of the video amplifier 12 is such that the pixel intensity prematurely turns off without reaching the full peak of the normal operating curve 51 and returns to the black level before the next pixel is displayed. There is a diminution in brightness which is compensated by the brightness circuitry 13.

Although the operating point 50 of FIG. 2 may be empirically obtained, as described above the, the relationship between the optimum operating point 50 on the frequency response curve of the video amplifier 12 and the slew rate of the video amplifier 12 is readily derivable by the routineer in the art utilizing well known principles of electrical engineering. FIG. 4 illustrates the optimum response where the interpixel space between the curves 52 and 53 just attains the black level.

In the beam narrowing operation illustrated in FIG. 4, the video amplifier 12 does not have sufficient time to fully saturate before turning off the beam prior to the generation of the next pixel. In other words, when operating at the point 50 a less than specified pixel size results because the turn on time of the video amplifier is slower due to the bandwidth limitations. This results in smaller, finer pixels that permit the significantly increased number of pixels per raster line when operating in accordance with the present invention.

While the invention has been described in its preferred embodiment, it is to be understood that the words which have been used are words of description rather than limitation and that changes may be made within the purview of the appended claims without departing from the true scope and spirit of the invention in its broader aspects.

I claim:

1. A method for enhancing the character display capacity of a display monitor with a video channel having a frequency bandwidth with a high frequency band edge, each character being displayed as selectively illuminated pixels in a character matrix, said display monitor being driven by a pixel clock having a clock frequency that determines the number of pixels displayed on a line of said monitor, comprising operating said pixel clock at a frequency at which beam narrowing occurs so that adjacent pixels are substantially distinct from each other, said pixel clock frequency being at a higher frequency than the clock frequency at which pixel smearing occurs, said clock frequency at which pixel smearing occurs being at a higher frequency than the clock frequency that results in operation of said monitor at said band edge, and arranging said character matrix so that at least a two pixel inter-character spacing is provided, thereby providing a legible display with enhanced character display capacity.

2. The method of claim 1 further comprising increasing display brightness by brightness compensating means coupled to said video channel to compensate for brightness diminution resulting from operating said pixel clock at the clock frequency at which beam narrowing occurs.

3. The method of claim 1 wherein said operating step comprises operating the pixel clock at a clock frequency at which separation just occurs between adjacent pixels so that an adequate black level exists therebetween.

4. Display monitor apparatus with enhanced character display capacity, each character being displayed as selectively illuminated pixels in a character matrix, comprising a monitor with a video channel having a frequency bandwidth with a high frequency band edge, and pixel clock means driving said monitor, said pixel clock means having a clock frequency that determines the number of pixels displayed on a line of said monitor, said pixel clock means operating at a pixel clock frequency at which monitor beam narrowing occurs so that displayed adjacent pixels are substantially distinct from each other, said pixel clock frequency being of a higher frequency than the clock frequency at which pixel smearing occurs, said clock frequency at which pixel smearing occurs being of a higher frequency than the clock frequency that results in operation of said monitor at said band edge, said character matrix being arranged to provide an inter-character spacing of at least two pixels, thereby providing a legible display with enhanced character display capacity.

5. The apparatus of claim 4 wherein said pixel clock means comprises means operating at said pixel clock frequency at which separation just occurs between adjacent pixels so that an adequate black level exists therebetween.

6. The apparatus of claim 4 further including brightness compensating means coupled to said video channel for increasing the brightness of said monitor to compensate for brightness diminution resulting from said pixel clock means operating at said pixel clock frequency.

* * * * *